US010622143B2

(12) United States Patent
Sakuma et al.

(10) Patent No.: US 10,622,143 B2
(45) Date of Patent: Apr. 14, 2020

(54) METHOD OF MANUFACTURING PERMANENT MAGNET

(71) Applicants: Senju Metal Industry Co., Ltd., Tokyo (JP); Toyota Jidosha Kabushiki Kaisha, Toyota-shi (JP)

(72) Inventors: Daisuke Sakuma, Aichi (JP); Kazuaki Haga, Aichi (JP); Takaaki Takahashi, Gifu (JP); Minoru Ueshima, Chiba (JP); Takashi Akagawa, Tochigi (JP); Yoshie Tachibana, Chiba (JP)

(73) Assignee: Senju Metal Industry Co., Ltd., Tokyo (JP)

( * ) Notice: Subject to any disclaimer, the term of this patent is extended or adjusted under 35 U.S.C. 154(b) by 101 days.

(21) Appl. No.: 15/729,828

(22) Filed: Oct. 11, 2017

(65) Prior Publication Data

US 2018/0102214 A1 Apr. 12, 2018

(30) Foreign Application Priority Data

Oct. 12, 2016 (JP) ..... 2016-201277

(51) Int. Cl.
*H01F 41/02* (2006.01)
*H01F 1/057* (2006.01)

(52) U.S. Cl.
CPC ..... *H01F 41/0253* (2013.01); *H01F 1/0571* (2013.01); *H01F 41/0293* (2013.01)

(58) Field of Classification Search
CPC .... H01F 41/0253; H01F 41/293; H01F 1/053; H01F 1/057; H01F 1/0571
See application file for complete search history.

(56) References Cited

U.S. PATENT DOCUMENTS

2002/0130305 A1 9/2002 Iyengar et al.
2004/0000355 A1 1/2004 Suga et al.
(Continued)

FOREIGN PATENT DOCUMENTS

CN 103871725 A 6/2014
CN 104737244 A 6/2015
(Continued)

OTHER PUBLICATIONS

Lu, An-Hui Zhao, Dongyuan Wan, Ying. (2010). Nanocasting—A Versatile Strategy for Creating Nanostructured Porous Materials—2.2.1.1 Controlled Pyrolysis of Carbon Precursors. (pp. 51). Royal Society of Chemistry. (Year: 2010).*
(Continued)

*Primary Examiner* — Keith D. Hendricks
*Assistant Examiner* — Joshua S Carpenter
(74) *Attorney, Agent, or Firm* — The Webb Law Firm

(57) ABSTRACT

In a method of manufacturing a permanent magnet having a curved surface, a permeating material including metal particles and a flux is applied to the curved surface of a magnet. The magnet to which the permeating material is applied is then positioned within a furnace and the furnace is placed in a vacuum or filled with inert gas to volatilize a solvent and the like of the flux contained in the permeating material. The furnace is set to be a temperature within a range of 300 through 500 degrees C. to heat the permeating material. This enables the flux to be carbonized to form reticulated carbon. The furnace is then set to be a temperature within a range of 500 through 800 degrees C. to melt the metal particles in the permeating material, thereby permeating the melted metal particles into the magnet through the reticulated carbon uniformly.

3 Claims, 4 Drawing Sheets

(56) References Cited

U.S. PATENT DOCUMENTS

| | | | | |
|---|---|---|---|---|
| 2008/0286595 | A1 | 11/2008 | Yoshimura et al. | |
| 2009/0176016 | A1* | 7/2009 | Long | C23C 14/246 427/248.1 |
| 2013/0078369 | A1 | 3/2013 | Shoji et al. | |
| 2013/0333807 | A1* | 12/2013 | Okada | B23K 35/36 148/25 |
| 2014/0366991 | A1* | 12/2014 | Brombacher | H01F 41/0293 148/121 |
| 2015/0228386 | A1* | 8/2015 | Sakuma | H01F 1/0577 419/27 |
| 2015/0235747 | A1 | 8/2015 | Miyamoto et al. | |
| 2017/0221630 | A1* | 8/2017 | Haga | H01F 41/0293 |
| 2017/0323723 | A1* | 11/2017 | Mino | B22F 3/10 |
| 2017/0330659 | A1 | 11/2017 | Mino | |
| 2018/0130581 | A1* | 5/2018 | Fujikawa | H01F 1/057 |
| 2018/0240590 | A1 | 8/2018 | Kuniyoshi | |

FOREIGN PATENT DOCUMENTS

| | | | | |
|---|---|---|---|---|
| CN | 107077965 | A | 8/2017 | |
| JP | 5169294 | A | 7/1993 | |
| JP | 2003318036 | A | 11/2003 | |
| JP | 200425305 | A | 1/2004 | |
| JP | 2004025305 | A | 1/2004 | |
| JP | 2005125243 | A | 5/2005 | |
| JP | 2009302236 | A | 12/2009 | |
| JP | 2011061038 | A | 3/2011 | |
| JP | 2011129648 | A | 6/2011 | |
| JP | 4924547 | B2 | 4/2012 | |
| JP | 2013197414 | A | 9/2013 | |
| JP | WO2012008623 | A1 * | 9/2013 | H01F 41/02 |
| JP | 2015201546 | A | 11/2015 | |
| JP | 2016178289 | A | 10/2016 | |
| WO | 2012036294 | A1 | 3/2012 | |
| WO | 2012118077 | A1 | 9/2012 | |
| WO | 2015156074 | A1 | 10/2015 | |
| WO | 2016093174 | A1 | 6/2016 | |

OTHER PUBLICATIONS

Espacenet translation of WO2012008623 retrieved on Apr. 22, 2019 (Year: 2012).*

Notice of rejection from Japan Patent Office and English translation thereof.

* cited by examiner

RELATED ART

METHOD OF MANUFACTURING PERMANENT MAGNET

CROSS REFERENCE TO RELATED APPLICATION

This application claims priority to Japanese Patent Application No. 2016-201277 filed Oct. 12, 2016, the disclosure of which is hereby incorporated in its entirety by reference.

BACKGROUND OF THE INVENTION

Field of the Invention

The present invention relates to a method of manufacturing a permanent magnet.

Description of Related Art

A rare-earth magnet using rare-earth element such as lanthanoid is also referred to as a permanent magnet which has been utilized in a driving motor or the like of a hybrid vehicle or an electric vehicle, in addition to a motor constituting a hard disk or magnetic resonance imaging (MRI) equipment. Recently, in order to cope with a requirement of high output for the driving motor or the like, the permanent magnet has been attempt to enhance coercive force thereof by permeating a permeating material such as Nd—Cu from a surface of the magnet to inside thereof.

For example, Japanese Patent Application Publication No. 2011-61038 discloses a method of manufacturing a rare-earth magnet containing the steps of sticking Nd—Cu alloy as the permeating material that can produce liquid phase onto a surface of a magnetic alloy containing a rare-earth element at a temperature lower than its eutectic point and heating after the sticking step to permeate and diffuse the permeating material into the grain boundary of the magnetic crystal grain of a magnetic alloy. Further, Japanese Patent Application Publication No. 2015-201546 discloses a method of manufacturing a magnetic substance containing NdFeB phase, which contains the steps of coating a slurry composition containing a metal particle of rare earth/Cu alloy and a binder and prepared to have a constant thixotropy and oxygen concentration on a surface of magnetic substance and heating the surface and a back surface of the magnetic substance at a temperature of 500 degrees C. or more and under decompression.

SUMMARY OF THE INVENTION

Although a permanent magnet having a rectangular shape is popularly used in the driving motor used in the hybrid vehicle or the like, such a permanent magnet having a rectangular shape is not always required, taking into consideration any improvement of directivity of the motor. For example, a permanent magnet having a curved surface such as a circular arc surface or an inclined surface may be effective for the driving motor used in the hybrid vehicle or the like.

When, however, manufacturing a permanent magnet with high coercive force having the curved surface such as a circular arc surface or an inclined surface, there may be a following issue. FIGS. 1A-1C are diagrams illustrating a problem of a past method of manufacturing a permanent magnet 110 which has a curved surface 122. When the permeating material 130 is applied to the curved surface 122 of a magnet 120 (FIG. 1A) and then, heated, the permeating material 130 is softened and dissolved, so that metal particles 132 are gathered into a central hollow portion of the curved surface 122 (FIG. 1B). This may inhibit the permeating material 130 from being permeated into regions (end sides) of the magnet 120 other than the central portion of the curved surface 122 (FIG. 1C), which may prevent the coercive force of the magnet 120 from being uniformly enhanced.

This invention addresses the above-mentioned issue and has an object to provide a method of manufacturing a permanent magnet which has a curved surface or an inclined surface whereby enhancing the coercive force thereof by diffusing the permeating material uniformly.

To achieve the above-mentioned object, the method of manufacturing the permanent magnet contains the steps of positioning the permeating material including metal particles and a flux on at least one surface of a magnet, the surface being the curved surface or the inclined surface, positioning the magnet on which the permeating material is positioned within a furnace that is drawn to vacuum or filling the furnace with inert gas, heating the magnet positioned in the furnace at a first temperature to form reticulated carbon by the flux, and melting the metal particles in the permeating material by heating the magnet positioned in the furnace at a second temperature which is higher than the first temperature to permeate the melted metal particles into the magnet through the reticulated carbon.

It is desirable to provide the method of manufacturing the permanent magnet which has a curved surface or an inclined surface wherein the metal particles include at least one of alloys selected from a group consisting of Nd—Cu alloy, Nd—Ga alloy, Nd—Al alloy, Nd—Mn alloy, Nd—Mg alloy, Nd—Hg alloy, Nd—Fe alloy, Nd—Co alloy, Nd—Ag alloy, Nd—Ni alloy, and Nd—Zn alloy.

It is also desirable to provide the method of manufacturing the permanent magnet which has a curved surface or an inclined surface wherein the first temperature is within a range of 300 through 500 degrees C. and the second temperature is within a range of 500 through 800 degrees C.

The concluding portion of this specification particularly points out and directly claims the subject matter of the present invention. However, those skilled in the art will best understand both the organization and method of operation of the invention, together with further advantages and objects thereof, by reading the remaining portions of the specification in view of the accompanying drawing(s) wherein like reference characters refer to like elements.

DESCRIPTION OF THE PREFERRED EMBODIMENT

Figure 1A:
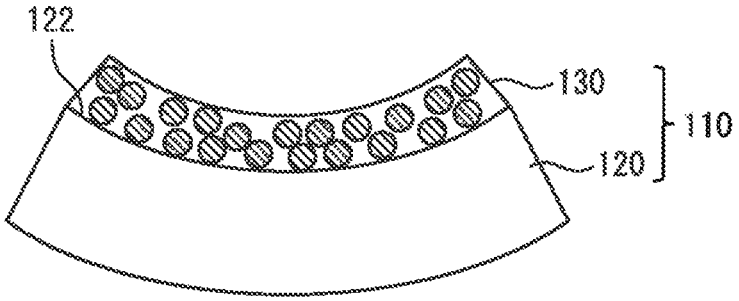
FIG. 1A is a diagram illustrating an example of a past method of manufacturing a permanent magnet.
Figure 1B:
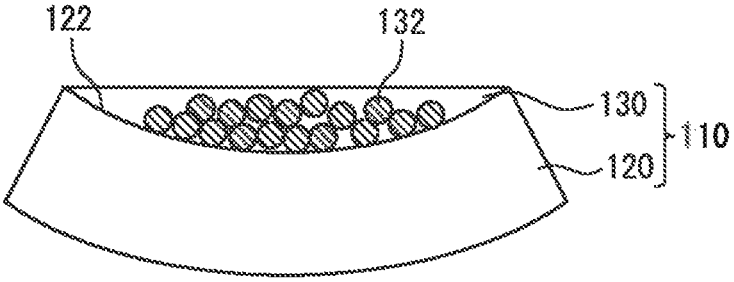
RELATED ART FIG. 1B
FIG. 1B is a diagram illustrating the example of the past method of manufacturing the permanent magnet.
Figure 1C:
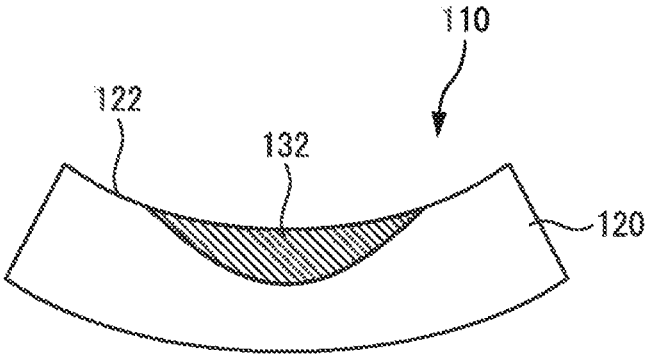
RELATED ART FIG. 1C
FIG. 1C is a diagram illustrating the example of the past method of manufacturing the permanent magnet.

The following will describe a method of manufacturing a permanent magnet as a preferred embodiment relating to the invention with reference to drawings. In the drawings, dimensions and ratios of parts shown therein are exaggerated and there may be a case where they may be different from the true ones.

First, the method of manufacturing a permanent magnet 10 as the preferred embodiment of the invention will be described. FIGS. 2A through 2E show the method of manufacturing the permanent magnet 10 with high coercive force according to the embodiment of the invention by permeating a permeating material 30 into a magnet 20.

Here, as the magnet 20, a material including Fe, Co, Ni or a combination of at least one species of these metals can be used. The magnet 20 used in this embodiment is entirely curved and has a circular arc surface 22 through which the permeating material 30 is permeated.

As the permeating material 30, for example, paste containing metal particles 32 and a flux 34 can be used. As the metal particles 32, for example, Nd—Cu alloy, Nd—Ga alloy, Nd—Al alloy, Nd—Mn alloy, Nd—Mg alloy, Nd—Hg alloy, Nd—Fe alloy, Nd—Co alloy, Nd—Ag alloy, Nd—Ni alloy or Nd—Zn alloy can be used. When the Nd—Cu alloy is used as the metal particles 32, it is preferable to set a percentage of Nd content to be within a range of 50 at % or more and 82 at % or less. In this range, a melting point of the Nd—Cu alloy is not greater than 700 degrees C. In the executed examples, 70Nd-30Cu alloy was used in the executed example. Numerals before the elements indicate atom % thereof.

As the flux 34, the flux containing any thixotropic agent, organic solvent, activator or the like can be used. As the flux 34, non- or low-residue type one is preferably used. The flux 34 has adhesion. When applying the flux to a curved or inclined surface, the flux 34 does not flow out, thereby allowing the metal particles 32 to stay in this place. In the executed example, NRB50 which was a flux of non-residue type manufactured by SENJU METAL INDUSTRIES CO., LTD was used as the flux 34.

Figure 2A:
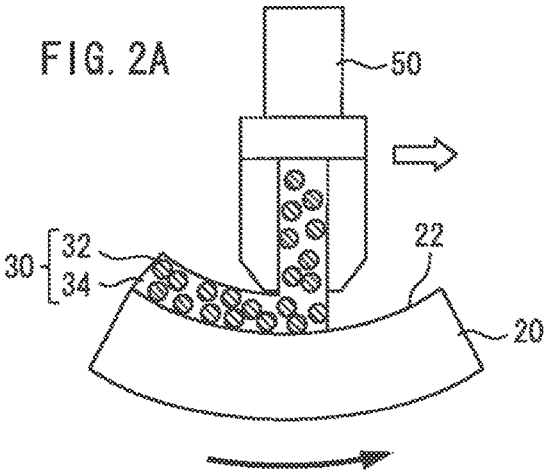
FIG. 2A is a diagram illustrating an example of a method of manufacturing a permanent magnet according to an embodiment of the invention.

First, as shown in FIG. 2A, the permeating material 30 is applied to a circular arc surface 22 of the magnet 20 (First Step). By using a coating machine 50 such as a mohno-pump, the permeating material 30 is applied. In this case, the permeating material 30 is applied while the magnet 20 is moved against the coating machine 50 and the permeating material 30 is formed on the curved surface 22 of the magnet 20 to have a constant thickness. After the application of the permeating material 30 to the magnet 20 is complete, the magnet 20 is mounted on a mounting table within a furnace (in a vacuum apparatus).

Figure 2B:
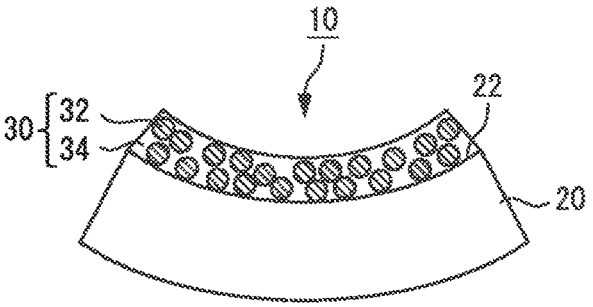
FIG. 2B is a diagram illustrating the example of the method of manufacturing the permanent magnet according to the embodiment of the invention.

Next, as shown in FIG. 2B, the inside of the furnace is drawn to vacuum to decompress to a set constant pressure (Second Step). The vacuum pressure is, for example, $10^0$ through $10^{-5}$ Pa. This allows liquid components such as the solvent in the flux 34 contained in the permeating material 30 to start the volatilization thereof.

Figure 2C:
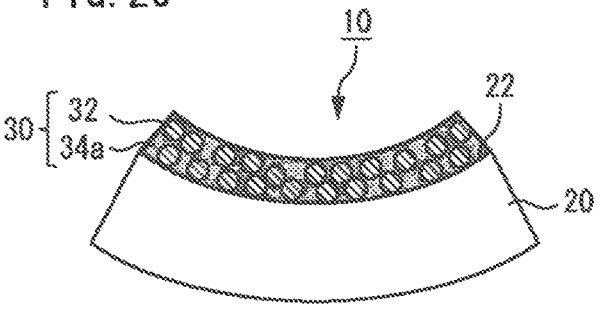
FIG. 2C is a diagram illustrating the example of the method of manufacturing the permanent magnet according to the embodiment of the invention.

Further, as shown in FIG. 2C, the furnace is heated to a set first temperature of 300 through 500 degrees C. to heat the permeating material 30. A period of heating time therefor is, for example, about one hour. This causes the thixotropic agent of the flux 34 contained in the permeating material 30 to be carbonized, so that reticulated (porous) fine carbon 34*a* is formed, thereby allowing the carbon 34*a* to hold the metal particles 32 contained in the permeating material 30 to their set positions (Third Step). Namely, the metal particles 32 are uniformly placed in the permeating material 30 without moving them to the central hollow portion of the curved surface 22.

Although the flux of non-residue type is used as the flux 34, the thixotropic agent is designed to volatilize together with solvent, as disclosed in Japanese Patent Application Publication No. 2004-025305. Since the liquid component previously volatilizes by the decompression, it is difficult to volatilize the thixotropic agent. Any other components than the thixotropic agent then volatilize with the heating, so that only the thixotropic agent remains. This is a condition in which the carbonization is easily caused, thereby forming the reticulated fine carbon 34*a*.

Figure 2D:
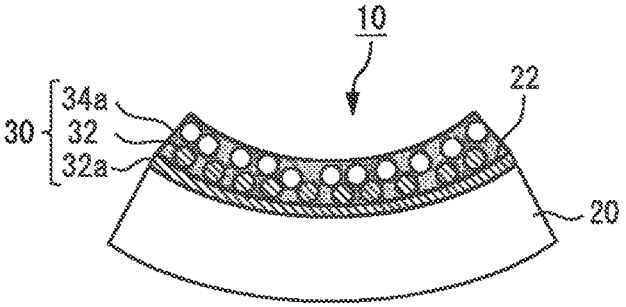
FIG. 2D is a diagram illustrating the example of the method of manufacturing the permanent magnet according to the embodiment of the invention.

Next, when a period of heating time at the above-mentioned temperature elapses, the furnace is heated to a set second temperature of 500 through 800 degrees C. to heat the metal particles 32 in the permeating material 30. A period of heating time therefor is, for example, 0.5 through 6 hours. This allows the metal particles 32 in the permeating material 30 to be melted, and allows the molten metal to permeate into the magnet 20 from the curved surface 22 of the magnet 20 through a network of the carbon 34*a*, as shown in FIG. 2D. Since the molten metal of the metal particles 32 passes through the fine network of the carbon 34*a* in this moment with the fine network of the carbon 34*a* holding the molten metal, the molten metal is uniformly permeated and diffused into the magnet 20 through the curved surface 22 (Fourth Step). FIG. 2D shows a situation where a part of the molten melt particles 32 is permeated and diffused into the magnet 20, and a metal layer 32*a* is formed on a surface side of the magnet 20.

Figure 2E:
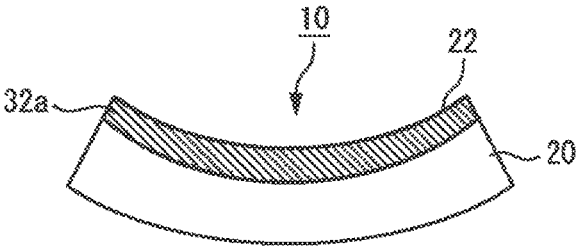
FIG. 2E is a diagram illustrating the example of the method of manufacturing the permanent magnet according to the embodiment of the invention.

Finally, when the permeation and diffusion of the permeating material 30 into the magnet 20 is complete, the curved surface 22 of the magnet 20 including the carbon 34*a* is polished to smooth the surface of the magnet 20, as shown in FIG. 2E. Such a series of steps enables to be manufactured the permanent magnet 10 in which the permeating material 30 is uniformly permeated into the magnet 20 through the curved surface 22 thereof.

As described above, according to the embodiment, it is possible to form the reticulated carbon 34*a* on the curved surface 22 of the magnet 20 by containing the flux 34 in the permeating material 30 and heating the flux. Accordingly, since the molten metal of the metal particles 32 pass through the carbon 34*a* with the network of the carbon 34*a* holding the molten metal, it is possible to permeate and diffuse the molted metal into the magnet 20 uniformly while the molten metal is prevented from being flown (gathered) to a central portion of the curved surface 22 of the magnet 20. As a result thereof, it is also possible to provide the permanent magnet 10 with enhanced coercive force.

Additionally, according to the embodiment, since the flux 34 of non- or low-residue type is used, it is possible to inhibit an obstruction of the permeation of the molten metal of the melted metal particles 32 into the magnet 20 by the residue.

Although the embodiment of the invention has been described, the invention is not limited thereto. Various kinds of alterations and/or improvements may be added to the above-mentioned embodiment without deviating from the spirit of this invention.

For example, although each step has been performed in the furnace that is in a state of vacuum in the above-mentioned embodiment, each step may be performed in the furnace that is filled with inert gas such as argon, nitrogen or the like. When each step is performed in the furnace that is filled with inert gas, flux of low-residue type is preferably used as the flux 34. Here, the flux of low-residue type is referred to as "flux causing flux residue of 20 wt % or less of whole of the flux". In this case, the inside of the furnace may be in a state of vacuum.

Although the permeating material 30 has been uniformly permeated to the magnet 20 through the curved surface 22 in the above-mentioned embodiment, the invention is not limited thereto. This method of manufacturing a permanent magnet according to the invention is applicable to an inclined surface of the magnet 20. Thereby, since the permeating material 30 can be uniformly permeated even to the inclined surface, it is possible to manufacture a permanent magnet 10 with high coercive force.

Although a case in which a surface of the magnet 20 is the curved surface 22 or the inclined surface has been described in the above-mentioned embodiment, the invention is applicable to a case in which a surface of the magnet 20 is a plane surface. This is because there may be a case where the permeating material 30 is permeated to the magnet 20 while the permeating material 30 is spread to a region slightly beyond the region to which the permeating material 30 is applied when the permeating material 30 is permeated to a plane surface of the magnet 20. Therefore, by applying this invention to the case in which a surface of the magnet 20 is a plane surface and forming the reticulated fine carbon 34*a* on the plane surface of the magnet 20, the carbon 34*a* holds the metal particles 32 in the permeating material 30 at their predetermined positions. This enables the permeating material 30 to be permeated and diffused to correctly desired positions in the plane surface of the magnet 20.

Although it has been an object to permeate the permeating material 30 uniformly to the curved surface 22 of the magnet 20 in the above-mentioned embodiment, the invention is not limited thereto. It is possible to change an applied amount of the permeating material 30 on purpose and to provide coercive force after the permeation and diffusion with distribution.

Figure 3:
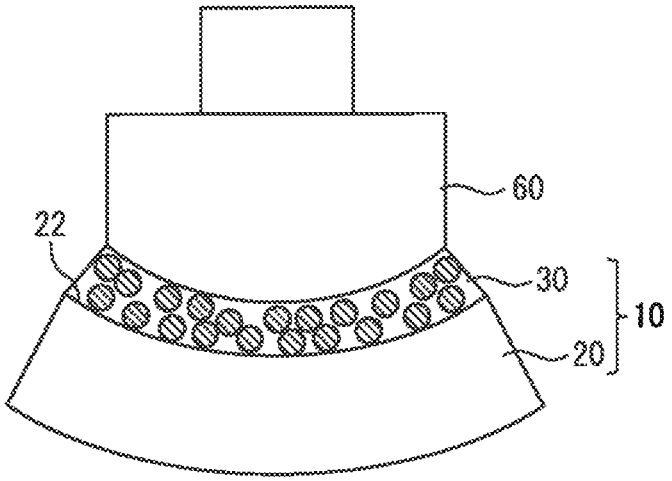
FIG. 3 is a diagram illustrating another applying method of a permeating material to a magnet.

Although the case where the coating machine 50 such as a mohno-pump is used in a method of applying the permeating material 30 has been described in the above-mentioned embodiment, the invention is not limited thereto. FIG. 3 shows another applying method of the permeating material 30 to the magnet 20. As shown in FIG. 3, a pump head 60 may move along the curved surface 22 of the magnet 20 to apply the permeating material 30 to the curved surface 22 of the magnet 20.

Although the flux of non- or low-residue type has been described as the flux 34 constituting the permeating material 30 in the above-mentioned embodiment, the invention is not limited thereto. For example, any flux including rosin or the like, which remains flux residue, may be used.

Executed Example

A permanent magnet as the executed example and a permanent magnet as the comparison example were manufactured and coercive force of the manufactured permanent magnets was measured.

First, the permanent magnet as the executed example was manufactured. Specifically, a magnet having a circular arc surface was manufactured and a chip A having a height (4 mm), a width (4 mm) and a length (2 mm) was cut out of a position in a section of the manufactured magnet. The coercive force of the cut-out chip A was measured. As a measurement apparatus therefor, Pulsed High Field Magnetometer (TPM) was used. The measured magnetic field of the meter was 80 kOe (10e=(250/π)A/m). The measured temperature was room temperature. Since the coercive force of the magnet before the permeating material was applied to the magnet was equal in the whole area thereof, the cut-out chip A may be cut out of everywhere in the magnet.

The permeating material in amount of 3.0 wt % in relation to weight of the magnet was then applied to the curved surface of the manufactured magnet with a thickness thereof being constant. The permeating material in which 70Nd-30Cu alloy, which was the metal particles, was contained in NRB50, which was flux of non-residue type, manufactured by SENJU METAL INDUSTRIES CO., LTD was used as the permeating material. As the applying apparatus, the mohno-pump was used. Further, the magnet to which the permeating material was applied was conveyed to a furnace in a vacuum apparatus, which was placed to, for example, $10^{-2}$ Pa and the magnet was heated at 350 degrees C. for one hour to form the reticulated carbon by the flux. The magnet was then heated at 600 degrees C. for 3 hours to permeate the molten metal particles into the magnet through the carbon, thereby manufacturing the permanent magnet according the executed example.

Figure 4:
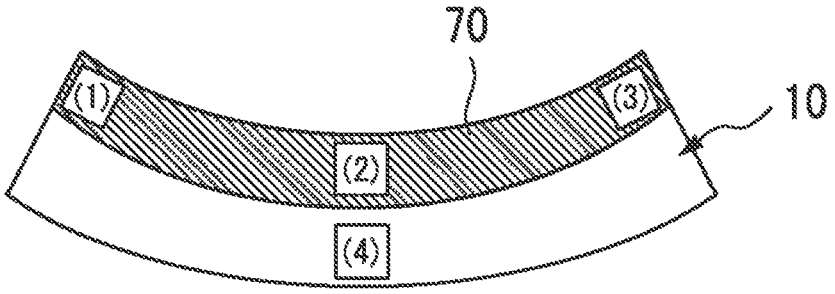
FIG. 4 is a diagram illustrating measurement points and chips which are cut out of a section of the magnet.

The manufactured permanent magnet was cut into a predetermined size and chips 1*a* through 4*a* were respectively cut out of four measurement points (1) through (4) in a section of the cut magnets. FIG. 4 shows the measurement points (1) through (4) and the chips 1*a* through 4*a*. As shown in FIG. 4, the measurement point (1) was positioned at a left end in an upper portion (the permeated region 70 of the permeating material) of the section of the cut magnet and the chip 1*a* having a height (4 mm), a width (4 mm) and a length (2 mm) was cut out of the measurement point (1). The measurement point (2) was positioned at a central portion in the upper portion of the section of the cut magnet and the chip 2*a* having a height (4 mm), a width (4 mm) and a length (2 mm) was cut out of the measurement point (2). The measurement point (3) was positioned at a right end in the upper portion of the section of the cut magnet and the chip 3*a* having a height (4 mm), a width (4 mm) and a length (2 mm) was cut out of the measurement point (3). The measurement point (4) was positioned at a central portion in a lower portion of the section of the cut magnet and the chip 4*a* having a height (4 mm), a width (4 mm) and a length (2 mm) was cut out of the measurement point (4).

The coercive force of each of the chips 1*a* through 4*a* cut out of the manufactured permanent magnet was then measured. TPM was used as the measurement apparatus. The measured magnetic field of the measurement apparatus was 80 kOe. The measured temperature was room temperature.

Next, the permanent magnet as the comparison example was manufactured. Specifically, a magnet having a circular arc surface was manufactured and a chip B having a height (4 mm), a width (4 mm) and a length (2 mm) was cut out of a position in a section of the manufactured magnet. The coercive force of the cut-out chip B was measured. As a measurement apparatus therefor, TPM was used. The measured magnetic field of the meter was 80 kOe. The measured temperature was room temperature.

The permeating material in amount of 3.0 wt % in relation to weight of the magnet was then applied to the curved surface of the manufactured magnet with a thickness thereof being constant. The permeating material in which 70Nd-30Cu alloy, which was the metal particles, was dispersed in ethylene glycol was used as the permeating material. As the applying apparatus, the mohno-pump was used. The magnet to which the permeating material was applied was then heated at 600 degrees C. for 3 hours to manufacture the permanent magnet concerning the comparison example.

The manufactured permanent magnet was cut into a predetermined size and chips 1*b* through 4*b* were respectively cut out of four measurement points (1) through (4) in a section of the cut magnets. The coercive force of each of the chips 1*b* through 4*b* cut out of the manufactured permanent magnet was then measured. The sizes of measurement points (1) through (4) and the chips 1*b* through 4*b*, the measurement apparatus for measuring the coercive force or the like are similar to those of the above-mentioned executed example, a detailed explanation of which will be omitted.

Figure 5:
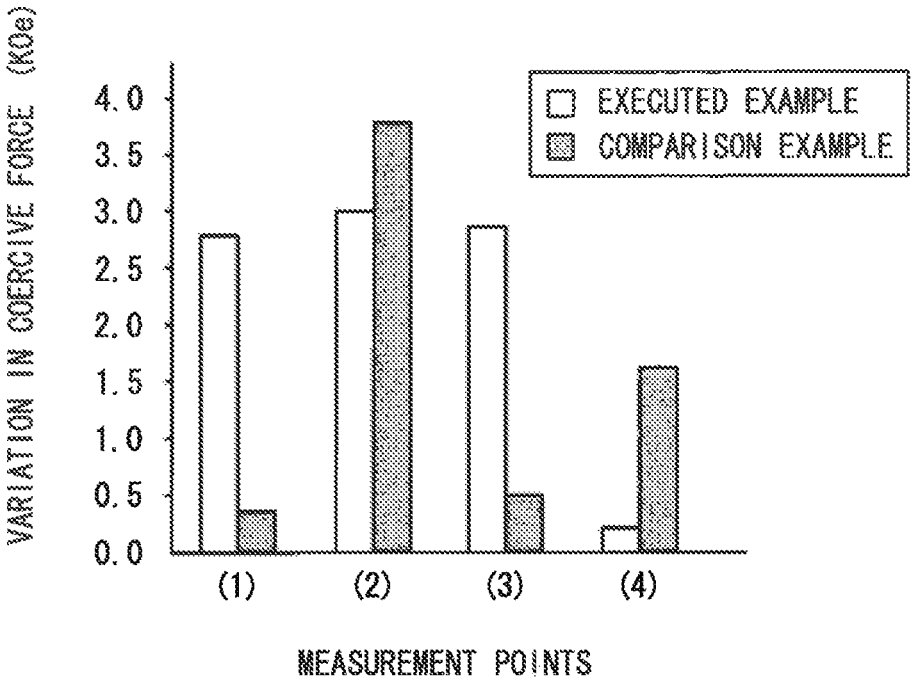
FIG. 5 is a graph showing a variation in coercive force of each of the chips before and after heat treatment.

FIG. 5 shows a variation in coercive force of each of the chips before and after heat treatment of the metal particles according to the executed example and the comparison example. In FIG. 5, a vertical axis indicates the variation in the coercive force of each of the chips before and after the heat treatment of the metal particles and a horizontal axis indicates each of the measurement points in the section of the permanent magnets. Further, in the executed example, the variation in the coercive force of each of the chips before and after the heat treatment of the metal particles was calculated by a difference between the coercive force of the chip A before the heat treatment and the coercive force of each of the chips 1*a* through 4*a* from the measurement points (1) through (4) after the heat treatment. In the comparison example, the variation in the coercive force of each of the chips before and after the heat treatment of the metal particles was calculated by a difference between the coercive force of the chip B before the heat treatment and the coercive force of each of the chips 1*b* through 4*b* from the measurement points (1) through (4) after the heat treatment.

As shown in FIG. 5, in the executed example, the variation in the coercive force of the chip 1*a* from the measurement point (1) was 2.8 kOe; the variation in the coercive force of the chip 2*a* from the measurement point (2) was 3.0 kOe; and the variation in the coercive force of the chip 3*a* from the measurement point (3) was 2.9 kOe. In the measurement points (1) through (3), the variation in the coercive force is increased by almost the same amount. Namely, the coercive force indicates an almost constant value over the whole upper side (the permeated region 70 of the permeating material) of the curved surface of the permanent magnet. Therefore, it has been determined that, by the permanent magnet according to the executed example, the permeating material can be uniformly permeated and diffused into the magnet even in the permanent magnet having the curved surface.

On the other hand, in the comparison example, as shown in FIG. 5, the variation in the coercive force of the chip 1*b* from the measurement point (1) was 0.4 kOe; the variation in the coercive force of the chip 2*b* from the measurement point (2) was 3.8 kOe; and the variation in the coercive force of the chip 3*b* from the measurement point (3) was 0.5 kOe. In the measurement point (2), the variation in the coercive force is increased while in the measurement points (1) and (3), the variation in the coercive force is not almost increased. Namely, the variation in the coercive force is increased at only the central portion in the upper portion of the curved surface of the permanent magnet. Therefore, it has been determined that, by the permanent magnet according to the comparison example, the metal particles in the permeating material are gathered to a central portion of the curved surface of the permanent magnet, so that the metal particles cannot be uniformly permeated and diffused into the magnet.

It should be understood by those skilled in the art that various modifications, combinations, sub-combinations and alterations may occur depending on design requirements and other factors insofar as they are within the scope of the appended claims or the equivalents thereof.

What is claimed is:

1. A method of manufacturing a permanent magnet, the method comprising the steps of:

positioning a permeating material including Nd-based metal particles and a flux containing a thixotropic agent on a surface of a magnet;

positioning the magnet on which the permeating material is positioned within a furnace that is drawn to vacuum or filled with inert gas;

heating the magnet positioned in the furnace at a first temperature to form reticulated carbon by the flux, and melting the metal particles in the permeating material by heating the magnet positioned in the furnace at a second temperature which is higher than the first temperature to permeate the melted metal particles into the magnet through the reticulated carbon.

2. The method according to claim 1, wherein the metal particles include at least one of alloys selected from a group consisting of Nd—Cu alloy, Nd—Ga alloy, Nd—Al alloy, Nd—Mn alloy, Nd—Mg alloy, Nd—Hg alloy, Nd—Fe alloy, Nd—Co alloy, Nd—Ag alloy, Nd—Ni alloy, and Nd—Zn alloy.

3. The method according to claim 1, wherein the first temperature is within a range of 300 through 500 degrees C. and the second temperature is within a range of 500 through 800 degrees C.

* * * * *